US005139431A

United States Patent [19]

Saitoh et al.

[11] Patent Number: 5,139,431

[45] Date of Patent: Aug. 18, 1992

[54] WATERPROOFING DEVICE FOR SCREW-TIGHTENED CONNECTORS

[75] Inventors: Hitoshi Saitoh; Makoto Yamanashi, both of Shizuoka, Japan

[73] Assignee: Yazaki Corporation, Tokyo, Japan

[21] Appl. No.: 725,861

[22] Filed: Jul. 2, 1991

[30] Foreign Application Priority Data

Jul. 9, 1990 [JP] Japan ..... 2-72278[U]
Oct. 17, 1990 [JP] Japan ..... 2-107981[U]

[51] Int. Cl.[5] ..... H01R 13/627
[52] U.S. Cl. ..... 439/364; 439/559
[58] Field of Search ..... 439/359, 362, 364, 352, 439/353, 356, 359, 364, 271, 587

[56] References Cited

U.S. PATENT DOCUMENTS 1,722,816 7/1929 Meunier ..... 439/364
2,892,172 6/1959 McGann, Jr. ..... 439/364
3,753,212 8/1973 Yamada et al. ..... 439/559
4,179,179 12/1979 Lowden ..... 439/364
4,483,575 11/1984 Krüger et al. ..... 439/359
4,684,190 8/1987 Clark et al. ..... 439/364
4,960,391 10/1990 Beinhaur et al. ..... 439/559

*Primary Examiner*—Gary F. Paumen
*Assistant Examiner*—Hien D. Vu
*Attorney, Agent, or Firm*—Sughrue, Mion, Zinn, Macpeak & Seas

[57] ABSTRACT

A pair of threaded-connection type connectors in which male and female connectors are mutually coupled to each other by engagement of a bolt provided in the male connector and a nut provided in the female connector, comprises a cylindrical sleeve extending from the male connector in a direction opposite to a connecting portion with the female connector, and a grommet for watersealingly covering the male connector except for the connecting portion thereof. The grommet includes an opening tightly fitted an outer cylindrical surface of the sleeve so that the bolt can be rotated without removing the grommet from the male connector and the grommet can define the waterproofed space therein together with the sleeve.

14 Claims, 3 Drawing Sheets

WATERPROOFING DEVICE FOR SCREW-TIGHTENED CONNECTORS

BACKGROUND OF THE INVENTION

The present invention relates to a device for waterproofing a pair of mutually screw-tightened connectors, and more particularly relates to a device for waterproofing a pair of mutually screw-tightened multi-terminal connectors which can be easily coupled to each other.

FIG. 6 shows a device for waterproofing a pair of mutually screw-tightened connectors 35 and 43. The device includes waterproofing rubber rings 40, a rubber grommet 41, and another rubber grommet 50. The connector 35 is secured to a panel 36 by screws 37. The secured connector 35 includes terminals chambers 38, and a nut 42. The waterproofing rubber rings 40 are fitted on electric wires 39 and inserted in the terminal chambers 38. The rubber grommet 41 is fitted on the housing of the secured connector 35 at the electric wire outgoing end 51 of the housing to prevent water from entering into the connector. The nut 42 is secured in the secured connector 35. The other connector 43 is adapted to be fitted to the secured connector 35. The fitted connector 43 includes a bolt 44, stoppers 45 and 46, and an electric wire holding plate 48. The bolt 44 is screw-engaged in the nut 42 so that the connectors 35 and 43 are coupled to each other. The head 47 of the bolt 44 is located at the outer portion of the fitted connector 43. The stoppers 45 and 46 are provided on the bolt to prevent it from moving in the axial direction thereof relative to the housing of the fitted connector 43. The other grommet 50 is fitted on the housing of the fitted connector 43 at the electric wire outgoing end 49 of the housing to prevent water from entering into the connector.

When the screw-tightened connectors 35 and 43 are to be either coupled to or uncoupled from each other, it is necessary to remove the waterproofing grommet 50 from the fitted connector 43 in order to turn the bolt 44. For that reason, it is troublesome to either coupled or uncoupled the connectors 35 and 43 to or from each other. This is a problem. Besides, since the grommet 50 is removed from the fitted connector 43 in order to turn the bolt 44, the rubber rings 40 need to be provided in the terminal chambers 38. For that reason, the diameter of each of the connector housing 35 and 43 is made large. This is also problem.

SUMMARY OF THE INVENTION

The present invention was made in order to solve the above-mentioned problems.

Accordingly, it is an object of the present invention to provide a device which is for waterproofing a pair of mutually screw-tightened connectors and is such that a grommet does not need to be removed from the corresponding connector in order to either couple or uncouple the connectors to or from each other, and waterproofing rings, the presence of which would increase the sizes of the connectors, do not need to be provided therein. A bolt is provided in one of the connectors and extends along the total length of the connector. A nut is provided in the other of the connectors. The bolt is screw-engaged in the nut so that the connectors are coupled to each other. The connectors are covered with covering means of the waterproofing device so that the connectors are waterproofed. The device is characterized in that the housing of the connector provided with the bolt is formed with a cylindrical sleeve surrounding the shank of the bolt; the covering means for the connector provided with the bolt has an opening in which the sleeve is tightly fitted for waterproof sealing; and a waterproofing seal means is provided on the bolt. In addition, it is possible that engagement flanges are provided on the housings of the connectors, the peripheral portions of the covering means are fitted on the flanges, and the outer surfaces of the peripheral portions are tightly fitted on a panel to which one of the connectors is secured. Since the bolt can be directly turned outside the opening of the covering means without removing it from the connector, the connectors can be efficiently coupled to and uncoupled from each other. Since the covering means does not need to be removed from the connector, the waterproofing rings do not need to be provided in the connectors. For that reason, the connectors can be made compact. Since the connectors are completely covered with the covering means, the waterproofing property of the device is high.

DETAILED DESCRIPTION OF THE PREFERRED EMBODIMENTS

Embodiments of the present invention are hereafter described in detail with reference to the drawings attached hereto.

Figure 1:
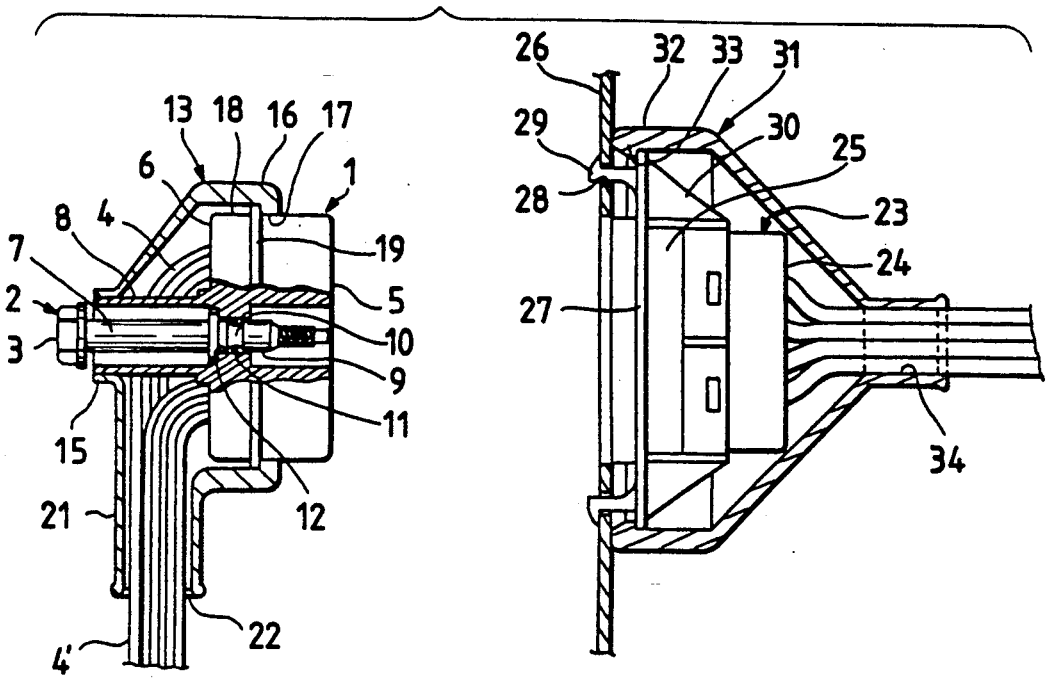
FIG. 1 is a longitudinally sectional view of a device which is an embodiment of the present invention and is for waterproofing a pair of mutually screw-tightened connectors.

FIG. 1 shows a device which is one of the embodiments and is for waterproofing a pair of mutually screw-tightened connectors 1 and 23. The device includes elastic rubber grommets 13 and 31, an O-ring 11, and tapes (not shown). The connector 1 is a fitted one, and includes a bolt 2, a housing 5, a cylindrical sleeve 8, a ring groove 10, and an engagement flange 19. The other connector 23 is a secured one, and includes a nut not shown in the drawings, a housing 24, and an engagement flange 27. The connector 23 is secured to a panel 26.

Figure 2:
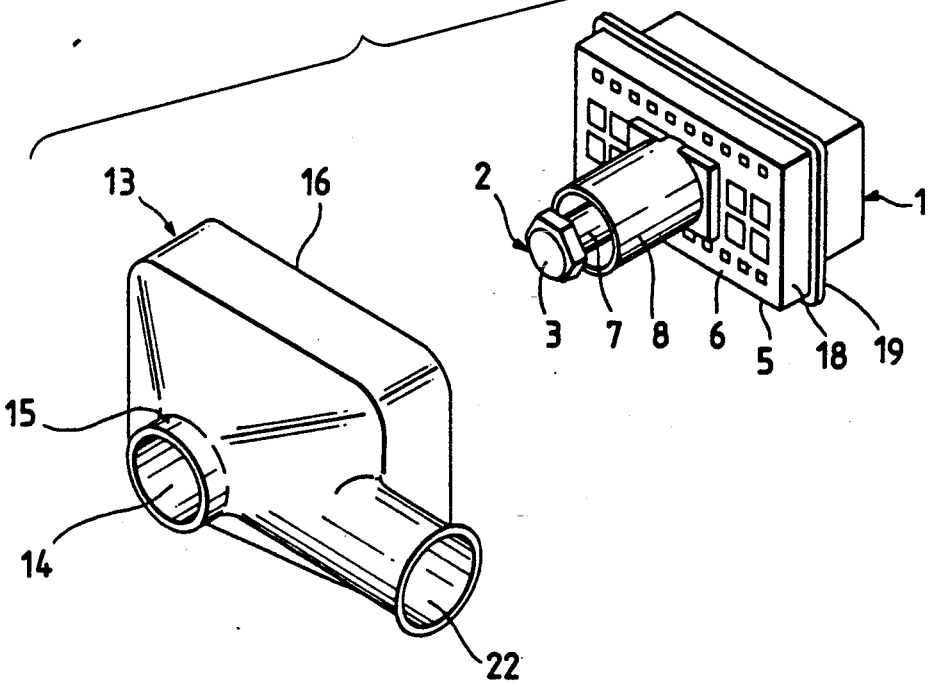
FIG. 2 is a perspective exploded view of the fitted connector and the grommet of the device.

The bolt 2 for coupling the fitted and the secured connectors 1 and 23 to each other extends at the central portion of the fitted connector 1 along the total length thereof so that the head 3 of the bolt is located outside the grommet 13, the housing 5 is made of a synthetic resin, and formed with the cylindrical sleeve 8 at the electric wire outgoing end 6 of the housing so that the sleeve surrounds the shank 7 of the bolt 2 and the head 3 of the bolt is exposed outside the sleeve, as also shown in FIG. 2. The portion 9 of the shank 7 of the bolt 2, which is located in the housing 5 of the fitted connector 1 has the ring groove 10 in which the O-ring 11 is fitted to serve as a waterproofing seal between the bolt and the inside surface 12 of the housing of the connector.

The elastic rubber grommet 13, which covers the electric wire outgoing side of the fitted connector 1, has a circular hole 14 having a diameter slightly smaller that the outside diameter of the cylindrical sleeve 8, and includes an annular boss 15 around the hole, and a peripheral portion 16 having an inward part 17. The engagement flange 19 is provided on the intermediate portion of the peripheral surface 18 of the housing 5 of the fitted connector 1 so that the flange is engaged on the inside surface of the inward part 17 of the peripheral portion 16 of the grommet 13. After electric wires 4 and 4' are taken out from the grommet 13 through the tubular portion 21 thereof, the cylindrical sleeve 8 of the fitted connector 1 is inserted into the hole of the grommet and the inward part 17 of the grommet is fitted on the engagement flange 19 so that waterproof sealing is performed on the sleeve, the grommet, the inward part and the flange. One of the tapes is wound on the electric wires 4 and 4' and the tubular portion 21 of the grommet 13 at the electric wire outlet port 22 thereof so that waterproof sealing is performed on the wires and the tubular portion.

The engagement flange 27 of the secured connector 23 is provided on the peripheral surface 25 of the housing 24 Of the connector near the panel 26 so that the flange projects from the peripheral surface. Hooks 29 for securing the connector 23 to the panel 26 are formed on the engagement flange 27 and project therefrom so that the hooks are fitted in the engagement holes 28 of the panel to secure the connector thereto. The engagement flange 27 is reinforced by props 30. The inward part 33 of the peripheral portion 32 of the grommet 31 is fitted on the engagement flange 27 at the periphery thereof. The grommet 31 covers the secured connector 23. The other of the tapes is wound on electric wires and the grommet 31 at the electric wire outgoing port 34 thereof so that waterproof sealing is performed on the wires and the grommet.

Figure 3:
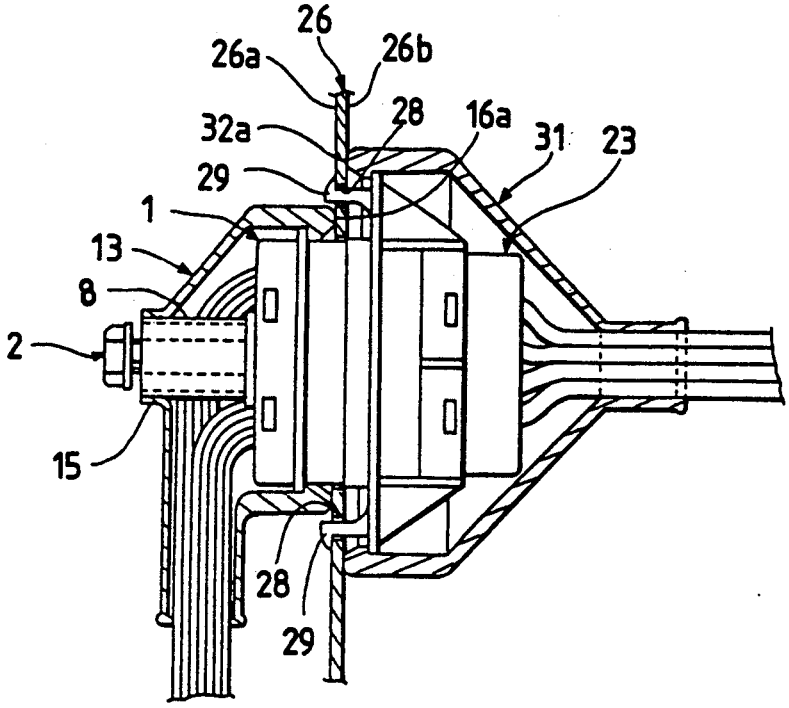
FIG. 3 is a longitudinally sectional view of the device in the state that the connectors are coupled to each other.

As shown in FIG. 3, the fitted and the secured connectors 1 and 23 are coupled to each other by engaging the bolt 2 of the fitted connector in the nut of the secured connector. Since the head 3 of the bolt 2 is always located outside the grommet 13, the bolt can either engaged in the nut and tightened or loosened and disengaged therefrom as the grommet remains fitted on the fitted connector 1. To couple the connectors 1 and 23 to each other, the fitted connector is inserted into the secured connector and the bolt 2 is engaged in the nut and tightened so that connectors are pulled toward each other such that the outer surfaces 16*a* and 32*a* of the peripheral portions 16 and 32 of the grommets 13 and 31 are respectively placed in tight contact with the sides 26*a* and 26*b* of the panel 26. As a result, the connectors 1 and 23 are completely sealed by the grommet 13 and 31.

Figure 4:
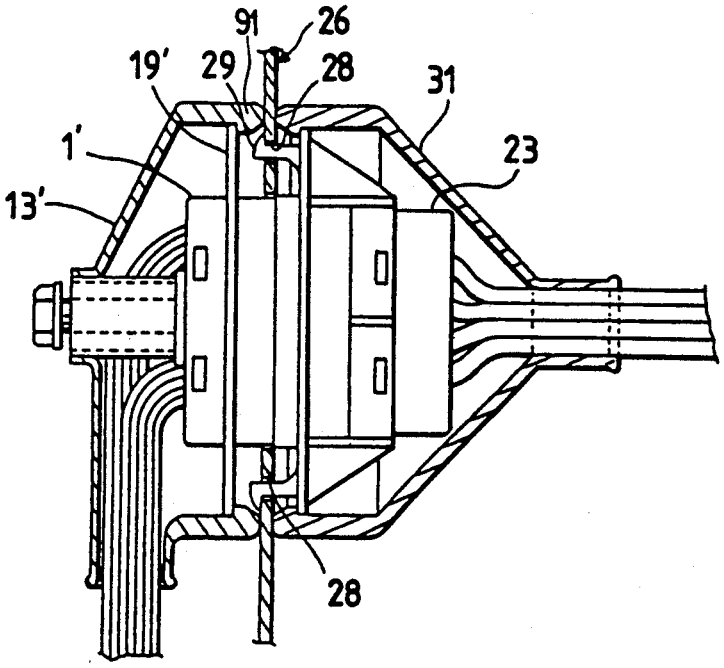
FIG. 4 is a longitudinally sectioned view of a waterproofing device which is a modification of the embodiment.

FIG. 4 shows a waterproofing device which is a modification of the embodiment shown in FIGS. 1, 2 and 3. As for the device, the engagement, or outward, flange 19, of a fitted connector 1' is made as large in size as the flange 27 of a secured connector 23, and a grommet, or cover, 13' for the fitted connector is made so large in size that the engagement holes 28 of a panel 26 are located inside the grommet to prevent water from entering into the device through the engagement holes. The grommet 13' includes an inward flange 91 disposed between the engagement flange 19' and the panel 26. As a result, the connectors 1' and 23 are more completely sealed by the device than by the device shown in FIGS. 1, 2 and 3.

Figure 5:
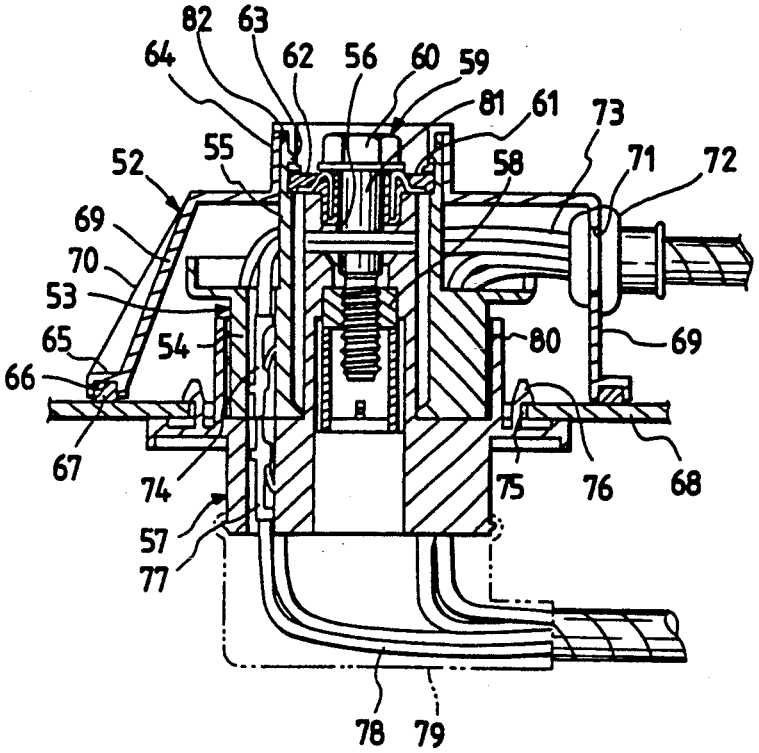
FIG. 5 is a longitudinally sectional view of a device which is another embodiment of the present invention ad is for waterproofing a pair of mutually screw-tightened connectors.

FIG. 5 shows a device which is another embodiment of the present invention and is for waterproofing a pair of mutually screw-tightened connectors 53 and 57. The device includes a waterproofing cover 52 made of a synthetic resin, a seal member 61, a seal ring 67, and an elastic rubber grommet 72.

The fitted connector 53 includes a housing 54, a cylindrical sleeve 55, a step 56, a bolt 59, and terminals 74. The cylindrical sleeve 55 is formed on the central portion of the housing 54. The step 56 is formed on the inside of the sleeve 55. The bolt 59, which is engaged in the nut 58 of the secured connector 57, is rotatably fitted in the step 56. The seal member 61 is provided on the shank 81 of the bolt 59 between the head 60 thereof and the step 56 and fitted in the annular groove 62 of the inside surface of the cylindrical sleeve 55 so that the seal member is held by engagement projections 63 provided over the groove. The upper annular portion 64 of the waterproofing cover 52, which has a hole 82, is tightly fitted on the outside surface of the cylindrical sleeve 55. In addition, the waterproofing cover 52 includes a wrap member substantially L-shaped in cross section, one end of which is integrally formed on a tip end of the upper annular portion 64, and the other end of which sealingly contacts the seal member 61, so that the waterproof property is attained between the outer surface of the sleeve 55 and the inner surface of the upper annular portion 64.

The secured connector 57 includes the nut 58, securing hooks 76, terminals 77, and a cover 79.

The seal ring 67 made of polyurethane or the like is fitted in a seal groove 66 provided in the waterproofing cover 52 at the peripheral portion 65 thereof, and is kept in tight contact with the surface of a panel 68 to which the connector 57 is secured. Props 70 are appropriately provided on the outer circumferential surface 69 of the waterproofing cover 52, and extend from the top of the cover toward the bottom thereof. The rubber grommet 72 is fitted in the electric wire hole 71 of the cover 52. Electric wires 73 are connected to the terminals 74 housed in the housing 54 of the filed connector 53 and not provided with a waterproofing means on the terminals, and are taken out from the cover 52 through the electric wire hole 71 thereof. When the securing hooks 76 of the secured connector 57 are fitted in the engagement holes 75 of the panel 68 to secure the connector thereto, the terminals 77 of the connector are connected to those 74 of the fitted connector 53 so that electric wires 78 connected to the terminals 77 extend out from the secured connector through the cover 79 thereof. The engagement holes 75 of the panel 68, the terminals 74 of the fitted connector and the mutually coupled portions 80 of both the connectors 53 and 57 are sealed together by the waterproofing cover 52.

Figure 6:
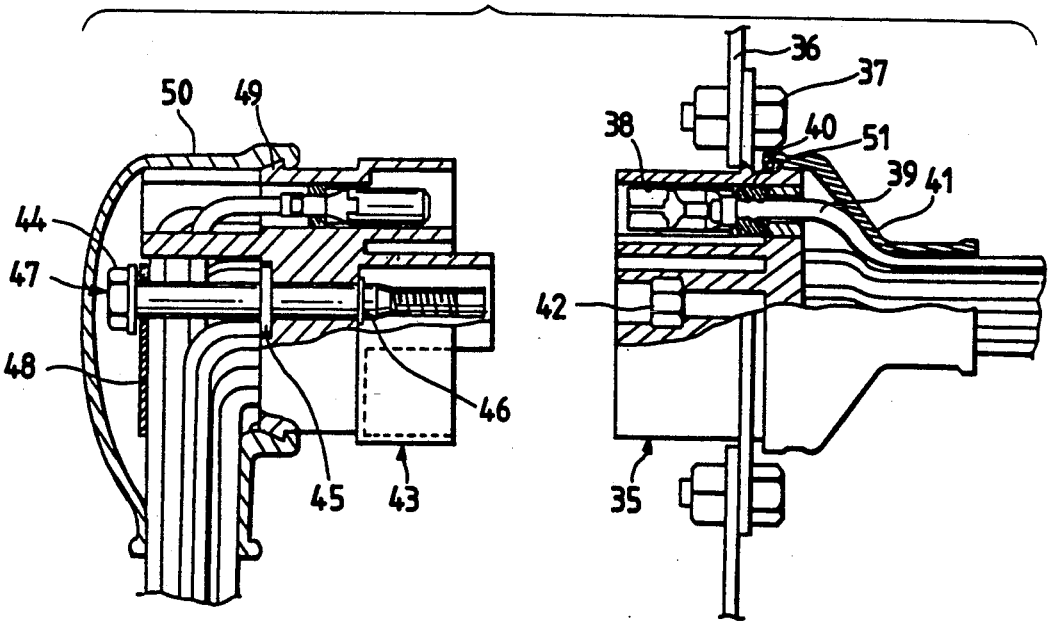
FIG. 6 is a longitudinally sectional view of a device for waterproofing a pair of mutually screw-tightened connectors, which device is a related art of the invention.

When the bolt 59 of the fitted connector 53 is either engaged in the nut 58 of the secured connector 57 and tightened therewith to couple the connectors to each other or loosened and disengaged from the nut to uncouple the connectors from each other, the waterproofing cover 52 does not need to be removed from the fitted connector. For that reason, waterproofing rubber rings such as those 40 shown in FIG. 6 and a seal member do not need to be provided on the terminals 74 of the fitted connector 53 and the mutually coupled portions 80 of the connectors 53 and 57, respectively, and the connectors can be therefore made compact.

The present invention is not confined to the embodiments described above, but may be embodied or practiced in other various without departing the spirit or essential character of the invention.

What is claimed is:

1. A device for waterproofing a pair of mutually screw-tightened connectors each including a housing, in which a bolt is provided in one of said connectors and extends along the total length of the connector, and a nut is provided in the other of said connectors, said bolt being screw-engaged in said nut so that said connectors are coupled to each other, and said connectors being covered with elastic grommets so that said connectors are waterproofed, wherein the housing of said connector provided with said bolt is formed with a cylindrical sleeve surrounding the shank of said bolt, said grommet for said connector provided with said bolt has an opening in which said sleeve is tightly fitted, and a waterproofing seal means is provided on said bolt wherein engagement flanges are provided on the housings of the connectors and extend radially therefrom so as to have opposing end surfaces, peripheral portions of the elastic grommets are fitted on said flanges so as to circumscribe said flanges, the inner surface of each of said grommets sealingly engaging each of said end surfaces and the outer surfaces of said peripheral portions being tightly fitted on a panel to which one of said connectors is secured.

2. A device for waterproofing connectors, comprising:

first and second connectors, each having a connection side and an opposite side;

a bolt rotatably supported to said first connector;

a nut fixedly disposed in said second connector for coupling said connection side of said first connector to said connection side of said second connector by threading engagement between said bolt and said nut;

a cylindrical sleeve projecting from said opposite side of said first connector for surrounding said bolt;

a cover for covering said opposite side of said first connector; and a fastener for fixing said second connector to a panel having fixing holes, wherein said first connector includes an outward flange projecting radially outwardly therefrom and said cover circumscribes said outward flange when said cover covers said exposed side of said first connector such that said fixing holes are covered by said cover.

3. The device according to claim 2, further comprising sealing means for water-proofing between said bolt and an inner cylindrical surface of said sleeve.

4. The device according to claim 2, further comprising means for preventing said bolt from moving in an axial direction thereof relative to said first connector, and wherein said bolt includes a head exposed from said sleeve.

5. The device according to claim 2, wherein said cover includes a rubber grommet.

6. The device according to claim 2, wherein said cover includes an inward flange tightly fitted between said outward flange and said panel when said first connector is coupled to said second connector.

7. The device according to claim 6, wherein said fixing holes are positioned within a space defined by said outward flange and said inward flange.

8. A device for waterproofing connectors, comprising:

first and second connectors, each having a connection side and an opposite side;

a bolt rotatably supported to said first connector;

a nut fixedly disposed in said second connector for coupling said connection side of said first connector to said connection side of said second connector by threading engagement between said bolt and said nut;

a cylindrical sleeve projecting from said opposite side of said first connector for surrounding said bolt;

a cover for covering said opposite side of said first connector;

a fastener for fixing said second connector to a panel having fixing holes; and a second cover for covering said opposite side of said second connector, wherein said second connector includes an outward flange projecting radially outwardly therefrom and said second cover circumscribes said outward flange and includes an inward flange disposed along said outward flange when said second cover covers said exposed side of said second connector such that said second cover covers said fixing holes.

9. The device according to claim 8, wherein said inward flange is tightly fitted between said outward flange and said panel when said second connector is fixed to said panel.

10. The device according to lcaim 9, wherein said fixing holes are positioned within a space defined by said outward flange and said inward flange.

11. The device according to claim 2, wherein said cover includes a waterproofing cover made of a synthetic resin.

12. The device according to claim 11, wherein said cover includes a seal groove provided in said waterproofing cover at a peripheral portion thereof and a seal ring fitted in said seal groove.

13. A device for waterproofing connectors, comprising:

first and second connectors, each having a connection side and an opposite side;

a bolt rotatably supported in said first connector;

a nut fixedly disposed in said second connector for coupling said connection side of said first connector to said connection side of said second connector by threading engagement between said bolt and said nut;

a cylindrical sleeve projecting from said opposite side of said first connector for surrounding said bolt;

a cover means for covering said opposite side of said first connector, said cover means having an opening tightly fitted to an outer cylindrical surface of said sleeve; and a fastener for fixing said second connector to a panel having fixing holes, wherein said cover means includes a waterproofing cover made of a synthetic resin and includes a seal groove provided in said waterproofing cover at a peripheral portion thereof and a seal ring in said seal groove.

14. A device for waterproofing connectors, comprising:

first and second connectors, each having a connection sid and and opposite side;

a bolt rotatably supported in said first connector;

a nut fixedly disposed in said second connector for coupling said connection side of said first connector to said connection side of said second connector by threading engagement between said bold and said nut;

a cylindrical sleeve projecting from said opposite side of said first connector for surrounding said bolt;

a fastener for fixing said second connector to a panel having fixing holes; and a cover for covering said opposite side of said first connector, said cover having an opening tightly fitted to an outer cylindrical surface of said sleeve and a peripheral portion opposing said opening and tightly fitted on said panel.

* * * * *